US010283236B2

(12) United States Patent
Tremelling et al.

(10) Patent No.: US 10,283,236 B2
(45) Date of Patent: May 7, 2019

(54) CORROSION RESISTANT ELECTRICAL CONDUIT SYSTEM

(71) Applicants: ABB Technology AG, Zurich (CH); Darren Dale Tremelling, Apex, NC (US); Nikolaus Peter Zant, Raleigh, NC (US); Yan Gao, Memphis, TN (US); Letisha McLaughlin Lam, Raleigh, NC (US); Mark Drane, Collierville, TN (US); Cong Thanh Dinh, Collierville, TN (US); Ian Rubin de la Borbolla, Memphis, TN (US); Ronald White, Germantown, TN (US)

(72) Inventors: Darren Dale Tremelling, Apex, NC (US); Nikolaus Peter Zant, Raleigh, NC (US); Yan Gao, Memphis, TN (US); Letisha McLaughlin Lam, Raleigh, NC (US); Mark Drane, Collierville, TN (US); Cong Thanh Dinh, Collierville, TN (US); Ian Rubin de la Borbolla, Memphis, TN (US); Ronald White, Germantown, TN (US)

(73) Assignee: ABB Schweiz AG (CH)

( * ) Notice: Subject to any disclaimer, the term of this patent is extended or adjusted under 35 U.S.C. 154(b) by 0 days.

(21) Appl. No.: 15/550,455

(22) PCT Filed: Feb. 12, 2016

(86) PCT No.: PCT/US2016/017752
§ 371 (c)(1),
(2) Date: Aug. 11, 2017

(87) PCT Pub. No.: WO2016/130919
PCT Pub. Date: Aug. 18, 2016

(65) Prior Publication Data
US 2018/0025807 A1 Jan. 25, 2018

Related U.S. Application Data

(60) Provisional application No. 62/115,715, filed on Feb. 13, 2015.

(51) Int. Cl.
*H01B 7/28* (2006.01)
*H01R 4/64* (2006.01)

(52) U.S. Cl.
CPC ..... *H01B 7/2806* (2013.01); *H01R 4/64* (2013.01)

(58) Field of Classification Search
CPC ..... H01B 7/2806; H01B 7/28; H01R 4/64; H02G 3/06; H02G 3/0481; F16L 25/00; F16L 25/0036; F16L 58/182
(Continued)

(56) References Cited

U.S. PATENT DOCUMENTS 3,069,763 A 12/1962 Reynolds
3,268,240 A * 8/1966 Gerner ..... F16L 15/003 285/286.1
(Continued)

FOREIGN PATENT DOCUMENTS

DE 19925097 A1 12/2000
DE 69912943 T2 9/2004
(Continued)

*Primary Examiner* — Timothy J Thompson
*Assistant Examiner* — Guillermo J Egoavil
(74) *Attorney, Agent, or Firm* — Taft Stettinius & Hollister LLP; J. Bruce Schelkopf

(57) ABSTRACT

A corrosion resistant conduit system that protects against corrosion and against electrical shortage. The corrosion resistant conduit system includes: a multilayer conduit having a metal layer disposed between two polymeric layers, a conduit fitting having an electrically conductive component and a body having one or more layers of polymeric material, and means for conductively coupling the metallic layer of
(Continued)

the multilayer tube to the electrically conductive component of the fitting, which provides a continuous electrical path throughout the corrosion resistant conduit system.

13 Claims, 16 Drawing Sheets

(58) Field of Classification Search
USPC ..... 174/72 R; 285/286.1, 290.1, 290.4, 903
See application file for complete search history.

(56) References Cited

U.S. PATENT DOCUMENTS 3,434,900 A * 3/1969 Bender ..... F16L 15/08 156/182
3,452,318 A 6/1969 Tanges, Jr.
3,823,747 A 7/1974 Dembiak et al.
4,211,595 A 7/1980 Samour
4,216,802 A 8/1980 Bonnes et al.
4,296,950 A * 10/1981 Chamberlin ..... F16L 58/184 285/342
4,325,598 A 4/1982 Leonardo
4,445,733 A * 5/1984 Deel ..... H01R 4/64 439/391
4,696,908 A 9/1987 Gutter et al.
4,875,864 A 10/1989 Campbell
4,999,903 A 3/1991 Bujes
5,000,369 A 3/1991 Shotts et al.
5,054,679 A 10/1991 Shotts et al.
5,152,323 A 10/1992 Shotts et al.
5,520,223 A 5/1996 Iorio et al.
5,769,128 A 6/1998 Auvil et al.
5,888,104 A 3/1999 Mello et al.
5,911,585 A 6/1999 Zwit
6,000,436 A 12/1999 Auvil et al.
6,202,300 B1 3/2001 Yuzwalk
6,293,311 B1 9/2001 Bushi et al.
6,822,205 B2 11/2004 Rahn
6,976,510 B2 12/2005 Campagna et al.
7,306,476 B2 12/2007 Gerlich et al.
8,039,073 B2 10/2011 Lahijani
8,697,215 B2 4/2014 Lahijani
8,701,714 B2 4/2014 Jansson et al.
2004/0077194 A1 4/2004 Otto et al.
2017/0299091 A1* 10/2017 Gallucci ..... F16L 9/20
2018/0002544 A1* 1/2018 Gao ..... C09D 5/00

FOREIGN PATENT DOCUMENTS

DE 102008038039 A1 3/2010
EP 2130669 A1 9/2009
GB 2349751 A * 11/2000 ..... H01R 4/64
GB 2349751 A * 11/2000 ..... H01R 4/64
WO 2009146993 A1 12/2009

* cited by examiner

CORROSION RESISTANT ELECTRICAL CONDUIT SYSTEM

This application is the U.S. National Phase of International Application No. PCT/US2016/017752, filed Feb. 12, 2016, which claims priority from U.S. Provisional Application Ser. No. 62/115,715, filed on Feb. 13, 2015, each of which is incorporated herein in their entirety.

FIELD OF THE INVENTION

The present invention is a corrosion resistant electrical conduit system. In particular, the present invention relates to an electrical conduit system that includes metal conduits and fittings with polymeric interior and exterior layers that is continuously electrically grounded.

BACKGROUND OF INVENTION

The heavy-duty corrosion-resistant electrical conduit systems presently being used are typically comprised of coated metal electrical conduits and fittings. Present corrosion-resistant electrical conduit is generally fabricated by coating a standard pipe (the terms "pipe" and "conduit" are referred to interchangeably herein) with polymeric materials. The interior coating of the pipe is applied using a long spraying wand inserted inside the conduit. This method takes a significant amount of time and the resultant thickness of the polymer coating is inconsistent and, hence, requires more material than might otherwise be necessary to ensure adequate coverage. Additionally, the varying thickness of the interior coating reduces the conduit cross-sectional area and increases pulling force requirements for wires and cables.

The surfaces of the corrosion resistant conduit include two polymeric coats. The first and innermost surface coating is applied in a manner similar to the interior coating, while the second and outermost coating is applied by dipping the pipe into a heated organosol bath, then rotating the pipe until coated. For end product use, the finished conduits are then connected and fastened with other components in the conduit system using threaded ends or via non-threaded methods. Fittings, such as couplers and conduit bodies, are basic metal components, which also achieve corrosion resistance through polymeric coatings using an application process similar to the process used to coat the conduit. Connecting corrosion-resistant conduit and conduit fittings is subsequently a careful and time-consuming process, due to the tedious nature of maintaining the coatings through the mechanical actions of the conduit system assembly.

In certain environments, corrosion resistance is a significant limiting factor in determining the lifetime of electrical supply infrastructure. Currently, corrosion-resistant conduit systems include PVC-only conduit, fiberglass composite or traditional rigid metallic conduit over-coated with polymeric coatings. Plastic coatings prevent salts, cleaning products, and/or process chemicals, etc., from oxidizing the metallic components of the conduit system that would in turn lead to exposure of the conductor cables, connectors and associated components. This degree of corrosion also adversely affects electrical safety due to reduced electrical continuity of the electrical system, including grounding, and also may allow foreign objects to enter the conduit and directly impact conductors, which also increases the likelihood of faults.

The National Electrical Code® (NEC®) recognizes several types of conductors that are permitted to be used as equipment grounding conductors, including rigid metal conduit (such as steel, copper and aluminum). For example, steel (or aluminum) conduit used in secondary power distribution systems is designed in such a way that the steel conduit does not carry any appreciable electric current under normal operating conditions. However, under certain fault conditions, the metallic conduit, acting as an equipment grounding conductor, will carry most of the return fault current, or, in some cases, the conduit will be the only return path of the fault current to the source. NEC® Article 250 requires that the metal parts in an electrical system must form an effective low impedance path to ground in order to safely conduct any fault current and facilitate the operation of overcurrent devices protecting the enclosed circuit conductors. UL 514*c* describes non-metallic conduit, for different applications.

While threaded joints are preferred for rigid metal conduit ("RMC") and intermediate metal conduit ("IMC")—thick wall types of conduits—for thin walled conduit, such as electrical metallic tubing ("EMT"), there exists set screw and compression types of connections. Traditionally, the joints that formed the interfaces between conduit sections and between conduits terminated in conduit bodies or boxes were both electrical and mechanical. That is, for set-screw connected EMT, the set-screw provided both the electrical continuity and the mechanical fixation of the conduit system components. With thinner polymer coated conduit, there is not an acceptable method for electrical and mechanical assembly of the system components, as the thin walled metallic tube cannot be effectively threaded. However, the outer polymeric layer of the coated conduit may be dimensionally controlled such that a mechanical connection method may be utilized on the outer surface of the conduit. An ability to create an outer polymer layer that is stiffer or more abrasion resistant also allows the outer polymer layer to be used as a mechanical connection possibility.

The field installation of electrical conduit requires conduit that is capable of being field bent to form a curved path for cables and conductors. In addition, coated conduit does not crack or split and maintains surface protection against corrosion. For example, UL 6 specifically requires that the conduit exterior coating should not detach from its metal substrate after a straight conduit is bent into a 90 degree curvature. The use of prior art corrosion resistant conduit systems involves significant material and labor costs due to the complexity of the process of making conduit coated on the interior and exterior surfaces, as well as maintaining the corrosion resistant properties during field modification of the conduit (including conduit bending and fitting installation specific to each installation). The conduit coatings that are presently used on the exterior of corrosion resistant conduits are formulated to be applied in a bath, and also to be removed during the threading process. Due to limitations of available coating compounds, the resultant conduit outer coating is compliant, and prone to abrasion.

One difficulty with prior art coated conduits and fittings stems from threading each end of the conduit. This is the conventional corrosion resistant conduit-connection method and it increases field-labor over other conduit systems due to additional steps required to maintain corrosion resistance at this critical interface. During the cutting and threading of coated conduits, special attention is required in order to maintain the integrity of the polymer coating. This increase the installation time and the cost of the coated conduit system over that of a standard uncoated conduit system. Furthermore, tightening of the connections imparts forces on the conduit, fittings, and/or conduit bodies, which can damage the coatings. Accordingly, there is a need for a corrosion resistant electrical conduit system that can use push-fit connectors, which reduces (if not eliminates) torsional moments and stresses to the polymer coatings, with the added benefit of reduced installation time and efforts and increased reliability of the overall electrical distribution system.

Other corrosion resistant conduit systems of nonmetallic materials such as PVC and fiberglass do not offer the strength, stiffness and impact resistance of metallic based conduit systems. These systems also require hot boxes to effectively fabricate required custom bends during field installation. During field bending of the non-metallic conduit system, the section of conduit being modified requires heating to the point where the conduit may be easily bent, and then the conduit held in that position until the conduit sufficiently cools. As such, significant time is required to fabricate even the simplest field bend of PVC or fiberglass type conduits.

In order for metallic conduit to perform effectively as equipment grounding conductors, it is crucial that it is installed properly with tight joints. If a fault occurs, proper installation ensures a continuous, low impedance path back to the overcurrent protective device. If joints are not made up tightly or if there is a break in the ground fault current path under fault conditions, there is a possibility of electric shock for anyone (or anything) who comes in contact with the conduit system. Therefore, the NEC® requires all metal enclosures for conductors to be metallically joined together into a continuous electrical conductor connected to all boxes, fittings, and cabinets so as to provide effective electrical continuity. Polymer coated electrical conduit systems must comply with the same requirements as uncoated steel conduit systems and provide electrical continuity between coated conduits and coated conduit fittings. Accordingly, there is a need for a coated conduit system that can be easily constructed and forms a continuous electrical conductor system.

SUMMARY OF THE INVENTION

In accordance with the present invention, a corrosion resistant conduit system is provided that protects against corrosion and against electrical shortage. The corrosion resistant conduit system includes a multilayer conduit, a conduit fitting, and means for conductively coupling the metallic layer of the multilayer tube to the electrically conductive component of the fitting. The multilayer conduit has a first end, a second end and a hollow region extending therebetween and includes a metallic layer disposed between an exterior polymeric layer and the hollow region. The multilayer conduit can also include an interior polymeric layer disposed between the metallic layer and the hollow region. The conduit fitting includes an electrically conductive component, a polymeric outer layer, an interior and first and second openings for receiving multilayer conduits and providing access to the interior. The conduit fitting can also include an inner layer of polymeric material disposed between the metallic layer and the interior. The means for conductively coupling the metallic layer of the multilayer tube to the electrically conductive component of the fitting provides a corrosion resistant conduit system with a continuous electrical path throughout.

The polymer materials of the interior and exterior layers of the multilayer conduit and the inner and outer layers of the conduit fitting include multiple layers of polymer materials, or cross-linked polymers, or polyethylene and/or polypropylene. The metallic layer of the conduit and the electrically conductive component of the conduit fitting can be fabricated from any conductive metallic material, preferably steel, aluminum, copper, titanium or magnesium. The electrically conductive component of the conduit fitting can be a metallic body, a ground bar, grounding terminal, threaded metallic boss, a threaded metallic stud, an electrically conductive screw, a grounding ring, or a metallic layer disposed between the polymeric outer layer and the interior. The grounding ring can include: a substantially flat annular base having an exterior perimeter and an interior perimeter that defines an opening; a continuous perimetrical side wall extending from the exterior perimeter of the annular base; and one or more legs extending from the perimetrical side wall to distal ends, each leg having one or more teeth extending inwardly. The teeth penetrate the exterior polymeric layer of the multilayer conduit pipe and electrically contact the metallic layer, while the annular base contacts the metallic component of a conduit or fitting to provide an electrical path through the grounding ring.

In another embodiment, the conduit fitting includes a body made from a polymeric material and the electrically conductive component can be a ground bar. In other embodiments, the conduit fitting can be a push-fit, snap-fit, quarter-turn or releasable connector. In one embodiment, the conduit fitting includes a plurality of teeth located between the first opening and the interior and between the second opening and the interior. The teeth engage the polymeric exterior layer of the multilayer conduits and secure the multilayer conduits in the fitting.

In a preferred embodiment, the conduit fitting includes a passage extending between the first and second openings. The passage has at least one conduit stop to limit the insertion of a conduit into the fitting and the electrically conductive component is an annular grounding band for electrically connecting the two multilayer conduits. Preferably, the conduit fitting also includes one or more apertures filled with a clear plastic material and located intermediate the first and second openings. The apertures allow the user to view the interior of the fitting to confirm that there is electrical continuity between the conduits and that the wires or cables are properly installed in the conduits.

BRIEF DESCRIPTION OF THE FIGURES

The preferred embodiments of the corrosion resistant electrical conduit system of the present invention, as well as other objects, features and advantages of this invention, will be apparent from the accompanying drawings wherein.

DETAILED DESCRIPTION OF THE INVENTION

Figure 1:
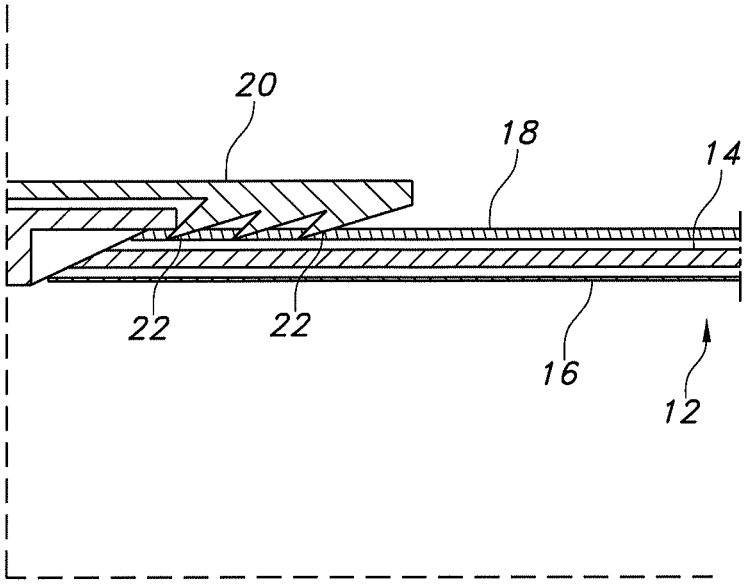
FIG. 1 is a cut-away view of a corrosion resistant conduit and a conduit fitting of the present invention.

The present invention is a corrosion resistant electrical conduit system that is principally used for electrical conduits and associated systems for the protection of electrical supply conductors and other wiring networks. The conduit system typically connects a number of electrical junction boxes or conduit bodies and provides flexibility in wiring within the electrical conduit system, allowing a minimal number of joints between discrete conductors along the electrical network. The wiring can be individual or multiple solid or stranded wires with a polymer sheath or a cable. As used herein, the term "cable" refers to one or more electrical conductors or wires, some of which may be insulated or uninsulated; one or more optical fibers, filaments, cables or waveguides; one or more electrical signal transmitting cables, such as shielded or coaxial cables; and/or any suitable combination of the foregoing. In some examples, the "cable" may include an electrical cable that includes a plurality of electrical conductors or wires, of which some may be insulated and some may be uninsulated, with the plurality of electrical conductors of the electrical cable being, in some examples, encased within an insulated sheath. However, the invention is not limited by the types and sizes of the wires or cables that may be installed in the conduit system.

The corrosion resistant electrical conduit system protects against corrosion and against electrical shortage. In a first embodiment, the electrical conduit system includes a conduit, a conduit fitting and a means for electrically conductively coupling throughout each conduit member. The corrosion resistant conduit includes a metal pipe having an internal non-metallic layer and an external non-metallic layer. The conduit fitting has a metal core and an internal non-metallic layer and an external non-metallic layer. The non-metallic layers for the conduit and conduit fitting include a polymer material that provides protection to the metal pipe against corrosion and electrical shortage. The means for conductively coupling, preferably an electrically conductive grounding ring, electrically connects the metal pipe of the conduit to the metal core of the conduit fitting to provide a continuous electrical ground throughout the conduit system.

In a second embodiment, the corrosion resistant conduit system includes a multilayer tube having a hollow region extending therethrough. The multilayer tube includes a metallic layer disposed between first and second polymeric layers. The first polymeric layer has a first inner surface and a first outer surface, wherein the hollow region extends within a region bounded by the first inner surface. The metallic layer extends around the first outer surface of the first polymeric layer and has a second outer surface. The metallic layer can include a metallic sheet wrapped around the first outer surface. Preferably, the metallic layer has a second inner surface and the second inner surface is substantially completely in contact with the first outer surface of the first polymeric layer. The metallic layer can have a longitudinally extending seam that can include a welded joint. The second polymeric layer is extruded over the second outer surface of the metallic layer. Preferably, the second polymeric layer has a third inner surface and the third inner surface is substantially completely in contact with the second outer surface of the metallic layer. In a preferred construction, the first inner and outer surfaces, the second inner and outer surfaces, and the third inner surface are substantially cylindrical.

The multilayer tube is adapted so that at least one cable can extend within the hollow region of the multilayer tube, preferably the at least one cable includes at least one electrical conductor that can be insulated or uninsulated. The hollow region of the multilayer tube can also accommodate at least one insulated electrical conductor and at least one uninsulated electrical conductor.

The corrosion resistant conduit system can include at least one fitting engaged with an end of the multilayer tube that includes at least one electrically conductive member configured to engage the metallic layer and form an electrically conductive path between the metallic layer and the at least one fitting. The at least one conductive member can be configured to pierce at least one of the first and second polymeric layers and engage the corresponding at least one of the second inner surface and the second outer surface of the metallic layer.

The polymer materials of the internal and external layer of the conduit can be extruded, preferably coextruded, onto the interior and/or exterior surfaces of the metal pipe. The polymer materials of the internal and external layers of the conduit and conduit fitting can include polyethylene and/or polypropylene or can be cross-linked polymers. In preferred embodiments, the internal and external layers of the conduit and conduit fitting include multiple layers of polymer materials. Polytetrafluoroethylene (PTFE) can be co-polymerized into the internal polymeric layer to reduce the surface friction, thus making it easier to pull cable through the conduit. The multilayer polymers are typically two or more polymer layers that can contain different additives, such as colorants, flame retardants, antioxidants, plasticizers, conductive fillers, extenders, and crosslinking agents.

The metal pipe of the conduit and the metal core of the conduit fitting can be fabricated from carbon steel, stainless steel, aluminum, copper, titanium or magnesium. The conduit fitting can be a push-fit, snap-fit, quarter-turn or releasable connector type of fixation. The means for conductively coupling, e.g., the grounding ring, can be fabricated from copper or aluminum.

As used herein, the term "fitting" or "conduit fitting" refers to any device that can be connected to an electrical conduit and includes all types of electrical boxes and enclosures as well as all types of couplings and connectors, including but not limited to push-fit, snap-fit, quarter-turn, or releasable connectors.

The conduit system includes a multilayer polymer-metal-polymer composite electrical conduit and a fitting with polymeric external and optionally internal surface layers. The conduit's inner and outer polymeric layers provide corrosion resistance and electrical insulation, as well as a somewhat compliant outer layer so that fittings can be fixed to the outer wall of the conduit. The inner metal wall allows for rigidity as well as ductility, based on choice of material and thickness thereof. The fittings are constructed to allow easy-fit assembly of the conduit into the fitting. An easy fit method can be push-fit, snap-fit, quarter-turn, or releasable.

A preferred fabrication method of the conduit can be the extrusion molding of an interior and/or exterior layer on the conduit or the extrusion of multiple interior and/or exterior layers simultaneously (coextrusion) on the interior and/or exterior surfaces of the conduit. In this way, the invention's fabrication method departs from the present method of manufacturing rigid, corrosion-resistant conduit. In the current state of the art, polymer coatings are applied to rigid steel conduit on both the inner diameter (ID) and outer diameters (OD), with the outer diameter having a larger wall thickness so that the conduit is both abrasion- and corrosion-resistant. The inner wall of the current corrosion resistant metallic conduit is also coated manually using a spray nozzle attached to the end of a boom, or a swab, which is inserted from both ends to coat the interior wall of the conduit.

In standard extrusion, solid plastic pellets are gravity fed into a forming mechanism, where jacketed compression screws melt and feed the materials into a die. In contrast, coextrusion involves multiple extruders forming layered or encapsulated parts. Sometimes five or more materials are used in a single cycle, with each extruder delivering the precise amount of molten plastic needed for the operation. Unlike ordinary plastic mixing, each individual plastic retains its original properties, but is combined into a compound-material part. If mixed prior to extrusion, the characteristics of the individual materials may be altered, but the end result is a homogeneous product.

Not all plastics are suitable for coextrusion because some polymers will not adhere to others, although introducing an intermediate layer that adheres to both of the adjoining polymers can often solve this problem. Plastics with drastically different melting temperatures are also unsuitable for the process, as degradation will occur in the lower melting material. In order for materials to be coextruded, they must have similar melting temperatures.

The polymeric fitting can be fabricated using injection molding, over-molding or insert molding. Various molding methods and materials produce corrosion resistance, low materials costs, low fabrication costs, as well as the ability to create a quick and easy fit type connection. Thus, an installer can simply connect a length of conduit into the fitting, which would then prevent any degree of extraction. The interface between fitting and conduit can also be constructed in such a way that the barbs of the fitting allow for extraction of the conduit, with a helical arrangement of the barbs (common arrangement is axial rows of barbs). The fitting design can have an overmolded metallic core or skeleton, such that electrical conductivity between adjacent conduit sections is obtained. Methods for providing electrical continuity can include barbed metallic protrusions in the fitting which pierce the outer layer of the polymer coating, set screws that may or may not pierce the outer conduit coating, and washer-like connectors that contact the perimetrical edge of the conduit.

The prior art fittings and conduit bodies are fabricated from traditional metallic conduit materials (e.g., aluminum or steel) and consist of coatings of polymeric materials, which are applied through a dipping or spraying process. These coating processes do not produce a uniform coating thickness and the thickness of the polymeric material can vary, which limits the use of a push-fit type connectors for coupling adjacent conduits. The corrosion resistant conduits in the prior art are also susceptible to adhesive failure of the outer polymer layer to the metallic conduit core, which prevents the outer polymer layer of the conduit from being used for mechanical fixation. Fittings for the conduit system can be releasable nature or non-releasable, i.e. they cannot be removed without damaging the fitting and/or the conduit. Non-releasable fittings are preferably used in applications in which reconfiguration of the system is not anticipated, while non-releasable fittings are used in applications that are expected to last an extended period of time, such as buried conduit systems.

In the current market, corrosion-resistant water pipe most similarly resembles the envisioned rigid conduit in both construction and corrosion-resistant features by utilizing polymeric coatings. Electrical conduit and conduit bodies, however, are utilized for discrete conductors throughout their inner diameters (IDs), and, therefore, have markedly different design requirements than the water piping. Design differences for the conduit include desired UV-resistance, larger allowable bending radii, and the necessity for substantially smooth conduit IDs. Furthermore, electrical grounding is not expected for the water piping system, but is standard for electrical metallic conduits. Thus, corrosion resistant water pipe would not be suitable for use as an electrical conduit.

In a preferred embodiment, the conduit has a metal core (also referred to herein as a metal tube or metallic layer) formed by a metallic conduit pipe that has a polymeric layer on the exterior surface and, optionally, on the exterior surface. The thicknesses of the metal core and polymeric layers on the two surfaces are selected to provide the desired strength and protection from corrosion. The dimensions of the coated conduits and fittings comply with existing standards for electrical conduits of metallic constructions. Variations in the geometries of the conduits and fittings are envisioned. The sizes and/or dimensions of the conduit systems and fitting listed herein are for illustrative purposes only and are not intended to limit the scope of the invention in any way. Thus, thicker and thinner walls of larger and smaller diameters are not excluded from being utilized with the construction. For the RMC types of geometries, Table A may be found below. The thickness of the metal tube for a RMC construction is from 0.9 mm to 5 mm. The preferred thickness of the polymer layer on the interior surface, if present, is from 0.127 mm to 1.27 mm and the preferred thickness of the polymer layer on the exterior surface is from 0.25 mm to 2.5 mm. Common conduit lengths offered presently are 10 feet and 20 feet. For long conduit runs, this short conduit length results in significant installation time due to the number of joints, and an increased ground resistance, due to the contact resistance present at each joint. The ability to increase the length of each conduit segment would allow for reduction in joint fabrication time, which would be preferred in certain applications (e.g. bridges).

TABLE A

| Trade Size | * Length of finished conduit without a coupling attached | Outside Diameter | Minimum weight of ten lengths of finished conduit with one coupling attached to each length, (kg) | | Minimum pipe Thickness (mm) | |
|---|---|---|---|---|---|---|
| (inches) | (m) | (mm) | St. Steel | Aluminum | St. Steel | Aluminum |
| ⅜ | 3.04 | 17.15 | 23.46 | 8.08 | 0.94 | 0.94 |
| ½ | 3.03 | 21.34 | 36.12 | 12.40 | 1.16 | 1.16 |
| ¾ | 3.03 | 26.67 | 47.98 | 16.48 | 1.23 | 1.23 |
| 1 | 3.03 | 33.40 | 69.86 | 24.01 | 1.43 | 1.43 |
| 1¼ | 3.03 | 42.16 | 91.75 | 31.54 | 1.48 | 1.48 |
| 1½ | 3.03 | 48.26 | 113.63 | 39.08 | 1.60 | 1.60 |
| 2 | 3.03 | 60.33 | 151.59 | 52.10 | 1.71 | 1.70 |
| 2½ | 3.01 | 73.03 | 240.57 | 82.70 | 2.25 | 2.24 |
| 3 | 3.01 | 88.90 | 311.62 | 107.12 | 2.39 | 2.38 |
| 3½ | 3.01 | 101.60 | 379.37 | 130.41 | 2.55 | 2.54 |
| 4 | 3.01 | 114.30 | 443.83 | 152.58 | 2.65 | 2.64 |
| 5 | 3.00 | 141.30 | 599.64 | 206.14 | 2.90 | 2.89 |
| 6 | 3.00 | 168.28 | 796.71 | 273.89 | 3.23 | 3.22 |

* The lengths listed are for illustrative purposes only and do not reflect the lengths of the commercial products.

The multilayer corrosion resistant conduit of the present invention may be used to form Electrical Metallic Tubing (EMT) or thin-wall conduit. Likewise, the corrosion resistant conduit may be used to form Intermediate Metal Conduit (IMC) having tubing heavier than EMT. Examples of EMT and IMC wall thicknesses for the corrosion resistant conduit formed in accordance with the present invention are set forth below in Table B. The information in Table B is presented for illustrative purposes and the invention is not intended to be limited in any way by the dimensions set forth in Table B.

TABLE B

| | EMT: | ID (in) | wall (in) | OD (in) | IMC: | ID (in) | wall (in) | OD (in) |
|---|---|---|---|---|---|---|---|---|
| ½ | | .622 | .042 | .706 | | .655 | .08 | .815 |
| ¾ | | .824 | .049 | .922 | | 0.87 | .08 | 1.03 |
| 1 | | 1.049 | .057 | 1.163 | | 1.11 | .09 | 1.29 |
| 1¼ | | 1.380 | .065 | 1.510 | | 1.48 | .09 | 1.64 |
| 1½ | | 1.610 | .065 | 1.740 | | 1.68 | .10 | 1.88 |
| 2 | | 2.067 | .065 | 2.197 | | 2.16 | .10 | 2.36 |
| 2½ | | 2.731 | .072 | 2.875 | | 2.55 | .15 | 2.85 |
| 3 | | 3.356 | .072 | 3.5 | | 3.18 | .15 | 3.48 |
| 3½ | | 3.834 | .083 | 4 | | 3.67 | .15 | 3.97 |
| 4 | | 4.334 | .083 | 4.5 | | 4.17 | .15 | 4.47 |

Figure 2:
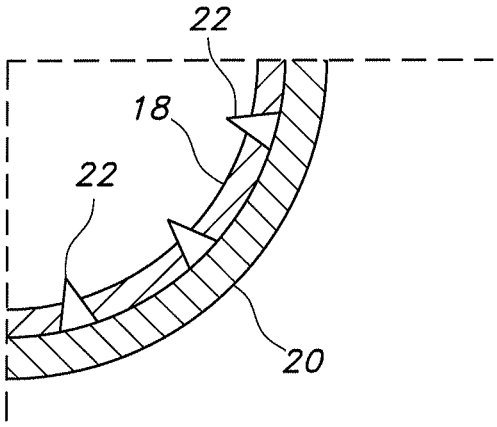
FIG. 2 is an end view of the conduit and fitting shown in FIG. 1 with the teeth of the fitting penetrating the exterior polymeric layer of the conduit.

Referring now to the figures, FIG. 1 is a side sectional view of a multi-layer conduit 10 with a metal core layer 12 disposed between an interior polymeric layer 14 and an exterior polymeric layer 16 inserted into a fitting 18. FIG. 2 is an end view of the fitting 18 shown in FIG. 1. FIGS. 1 and 2 illustrate a preferred embodiment of the multipurpose interface between conduit 10 and fitting 18 and are not intended to limit the scope of the invention in any manner.

FIG. 1 shows a conduit system 10 that includes a multilayer conduit 12 having a metal core layer 14, an interior polymeric layer 16 and an exterior polymeric layer 18 inserted into a fitting 20. In this embodiment, the polymeric teeth 22 of the fitting 20 (also shown in FIG. 2) grasp the outer polymeric layer 18 of the multilayer conduit 12. An end stop feature can be located in the middle of the fitting 20 to prevent the conduit 12 from being pushed through the length of the fitting 20. Preferably, metallic teeth 22 are incorporated longitudinally onto both sides of the end stop, and serve to pierce the outer polymeric layer 18 of the conduit 12 to provide electrical continuity between adjacent conduit sections and the fitting. The penetration of the polymeric layer 18 by the metallic teeth 22 can be clearly viewed in FIG. 2. Both metallic and polymeric teeth can be used for mechanically engaging the exterior surface of the conduit. The metallic teeth are used when it is desired to form an electrical path between the multilayer conduit 12 and the fitting 20.

The advantages of the conduit system include the following: low fabrication cost, easily manufactured, high fabrication speed (continuous fabrication method), flexibility of conduit fabrication (e.g., polymer and metal wall thicknesses so that various rigidities of conduit may be obtained—thick metal walls for rigid straight pieces and thinner metal walls for elbows—with same external look) compared to current conduit offering that is limited in wall thickness and polymer layer types, precision of conduit geometry, significant current variation in polymer coating wall thickness, lightweight conduit versus present metal conduit that is steel based, durable conduit (potential use of cross linked polymers) versus presently used thermoplastics, and ease of conduit system assembly (with potential easy-fit method) whereas present corrosion resistant conduit connections are threaded.

EXAMPLES

The examples set forth below serve to provide further appreciation of the invention but are not meant in any way to restrict the scope of the invention.

Example 1

Figure 3:
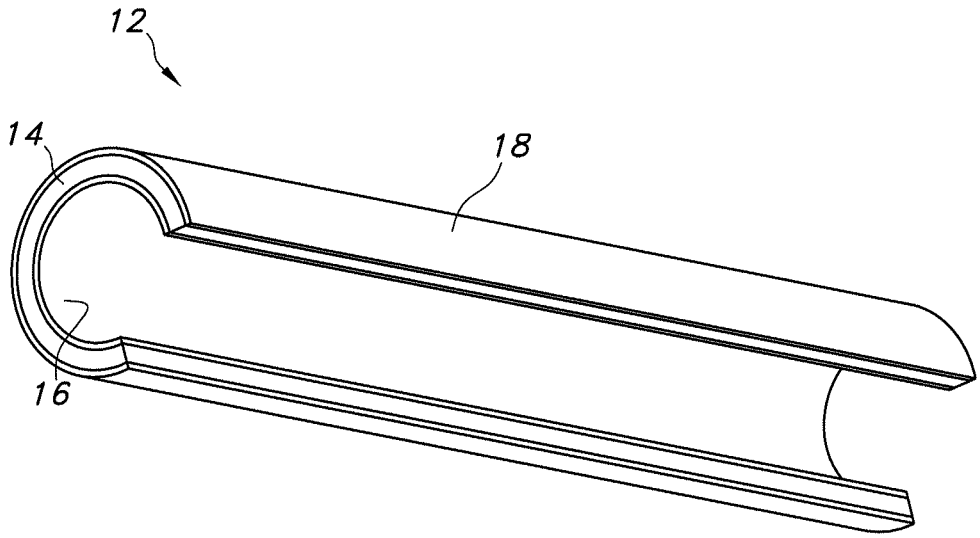
FIG. 3 is a peripheral view of a conduit of the present invention with interior and exterior polymeric layers with a section of the conduit wall removed.
Figure 4:
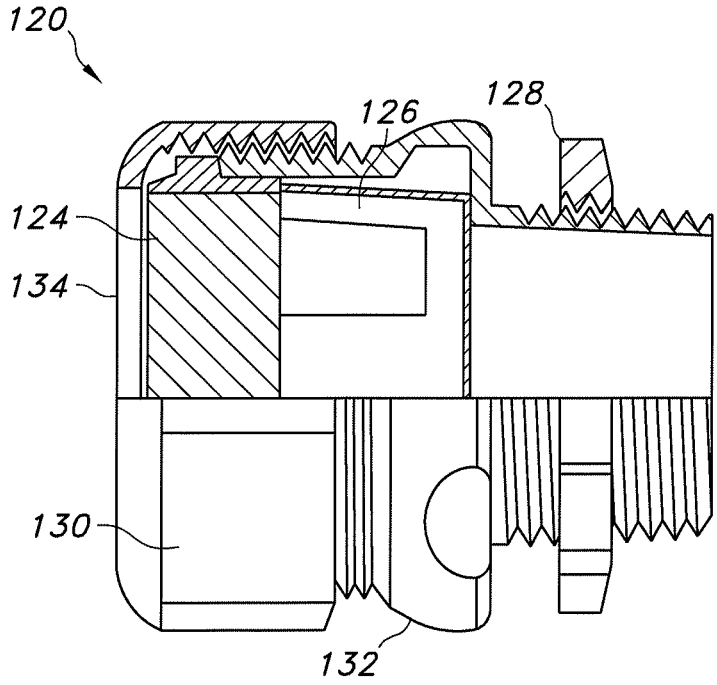
FIG. 4 is a sectional side view of a conduit fitting of the present invention with a grounding ring installed in the interior
Figure 5:
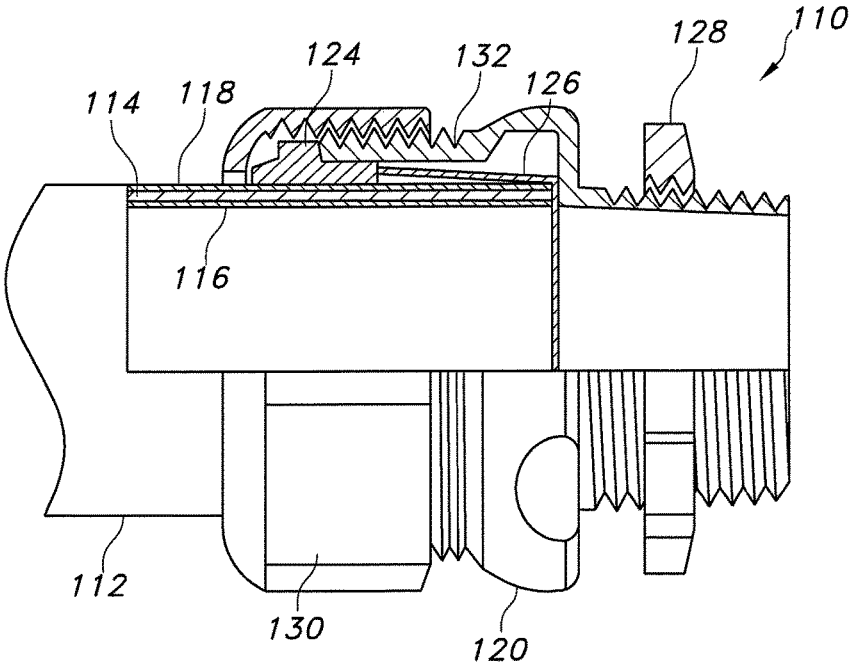
FIG. 5 is a sectional side view of a conduit fitting shown in FIG. 4 with a conduit installed in the fitting.

FIGS. 3-5 show examples of the components in one embodiment of the conduit system 10. FIG. 3 shows a cutaway view of a cylindrically shaped section of the multilayer conduit 12 formed from a core metallic layer 14 disposed between an inner polymeric layer 16 and an outer polymeric layer 18. Typically, the core metallic layer 14 is a pipe or a tube and can be made of an aluminum alloy, carbon steel, copper, magnesium, titanium or an alloy thereof. The polymeric layers 16, 18 can be a plastic material, preferably polyethylene and polypropylene to provide general resistance against corrosion. The internal layer 16 can also include a polytetrafluoroethylene (TEFLON®) or similar compound to provide additional low friction characteristics to facilitate pulling wires/cables through the conduit. FIG. 4 shows a fitting 120 that is used in an embodiment of the conduit system 110. As shown in FIG. 4, the fitting 120 includes a sealing ring 124, a grounding ring 126, a fastening nut 128, a gland nut 130, a fitting body 132, and an opening 134 for receiving a conduit. The conduit body can alternatively be made of stainless steel, thus eliminating the need of additional corrosion protection layers but increasing the cost.

Figure 6:
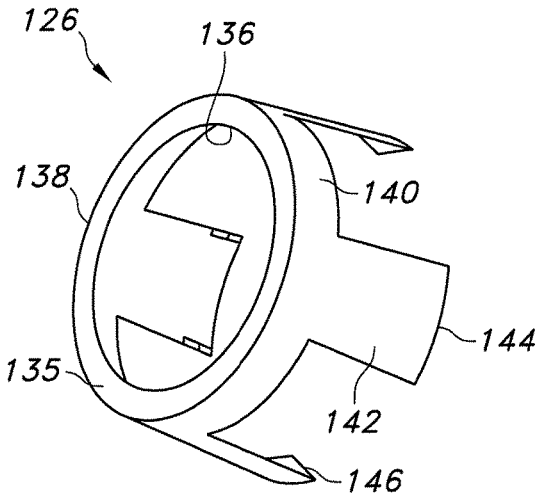
FIG. 6 is a first embodiment of a grounding ring used in the corrosion resistant conduit of the present invention.
Figure 7:
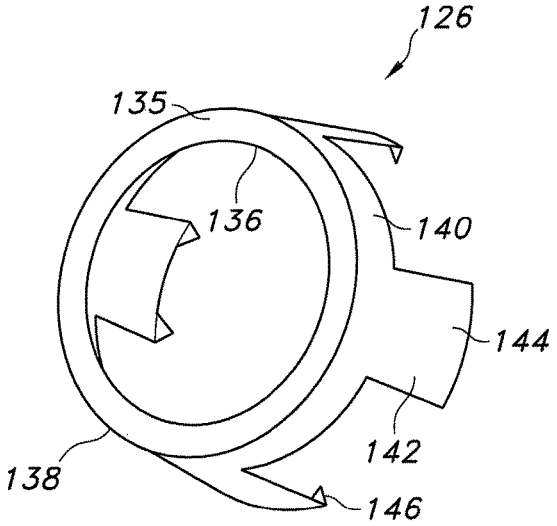
FIG. 7 is a second embodiment of a grounding ring used in the corrosion resistant conduit of the present invention.

FIG. 5 shows a preferred embodiment of the conduit system 110 wherein a multilayer conduit pipe 112 having a core metallic layer 114 disposed between an inner and out polymeric layer 116, 118, respectively, is inserted into the fitting 120 until the end of the conduit contacts the grounding ring 126 to create an electrical path between the conduit 112 and the fitting 120. The sealing ring 124 seals the fitting 120 around the external polymeric layer 118 of the conduit 112 when the gland nut 130 is fastened and then locked in place by the fastening nut 128. The sealing ring 124 also presses the grounding ring 126 against the fitting body 132. As shown in FIGS. 6 and 7, the grounding ring 126 has a substantially flat annular base 135 with an interior perimeter 136 and an exterior perimeter 138 and a perimetrical side wall 140 extending from the exterior perimeter 138 of the base 135. One or more legs 142 extend from the perimetrical side wall 140 to distal ends 144 that turn inwardly and have teeth 146. The teeth 146 of the grounding ring 126 penetrate the exterior polymeric layer 118 of the conduit pipe 112 and contact the metallic layer 114 of the conduit pipe 112. The contact between the metallic grounding ring 126 and the metallic layer 114 provides the electrical grounding path for the conduit system 110. The grounding ring 126 can be designed with various types and numbers of teeth 146, as shown in FIGS. 6 and 7.

Figure 8:
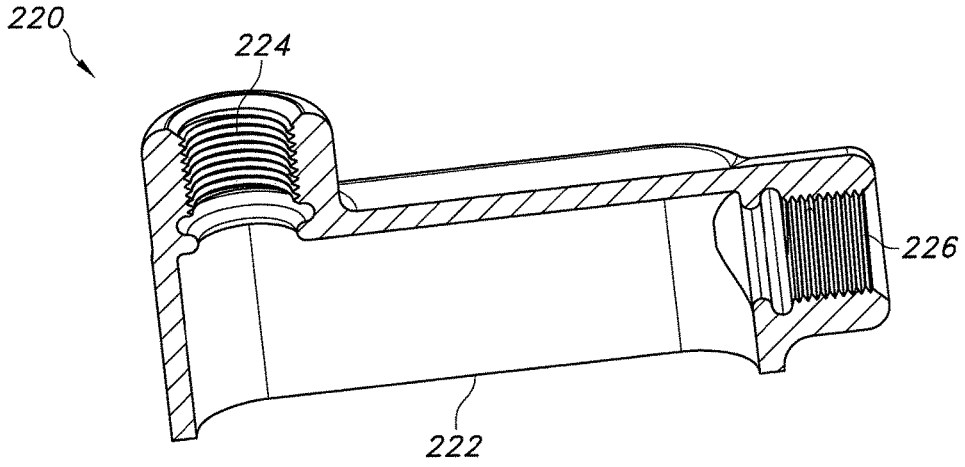
FIG. 8 is a cross-sectional view of a two-way conduit fitting of the present invention made from a polymeric material with threaded metallic connections.
Figure 9:
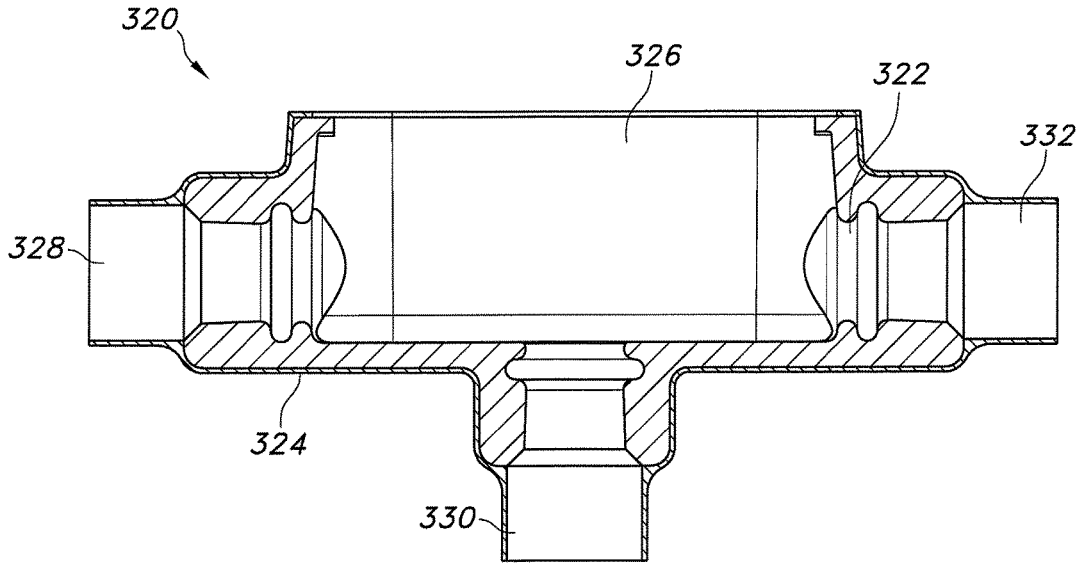
FIG. 9 is a cross-sectional view of a three-way conduit fitting of the present invention with interior and exterior polymeric layers.
Figure 27:
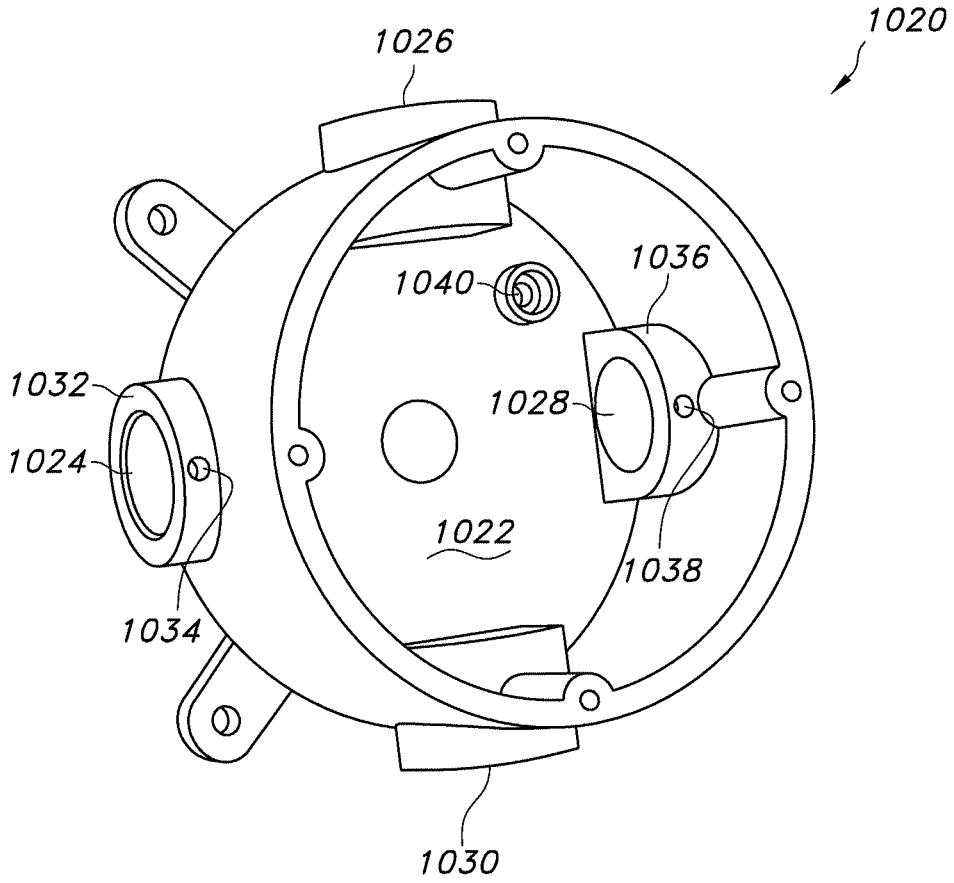
FIG. 27 is a peripheral view of a non-metallic box with set screw type electrical connections for conduit entry points.

FIGS. 8 and 9 show embodiments wherein the fitting is a conduit body. FIG. 8 shows a fitting 220 having a conduit body 222 formed of a non-metallic, preferably polymeric, material and having metallic inserts with two threaded connections 224, 226 molded into the body 222. The metallic inserts 224, 226 are electrically connected to provide a continuous electrical ground path through the fitting 220. The conduit body 222 can also be made from metal or a metal/polymer combination. FIG. 9 shows a fitting 320 with a metallic conduit body 322 having external 324 and internal 326 surfaces over-molded or covered with a polymeric layer. The fitting 320 has three conduit connections 328, 330, 332 and a metallic conduit body 322 that provides electrical grounding. Additional devices may be used in with the fittings and conduits for specific applications, such as sealing rings and various connectors. The features shown in FIGS. 8 and 9 for the conduit body can be applied to a 2-outlet conduit body design (FIG. 8), a 3-outlet conduit body design (FIG. 9), and a 4-outlet conduit body design (FIG. 27). The concepts also apply to conduit bodies with outlets axes configured at various angles, including 90°, 135° and 180°.

Example 2

Figure 10:
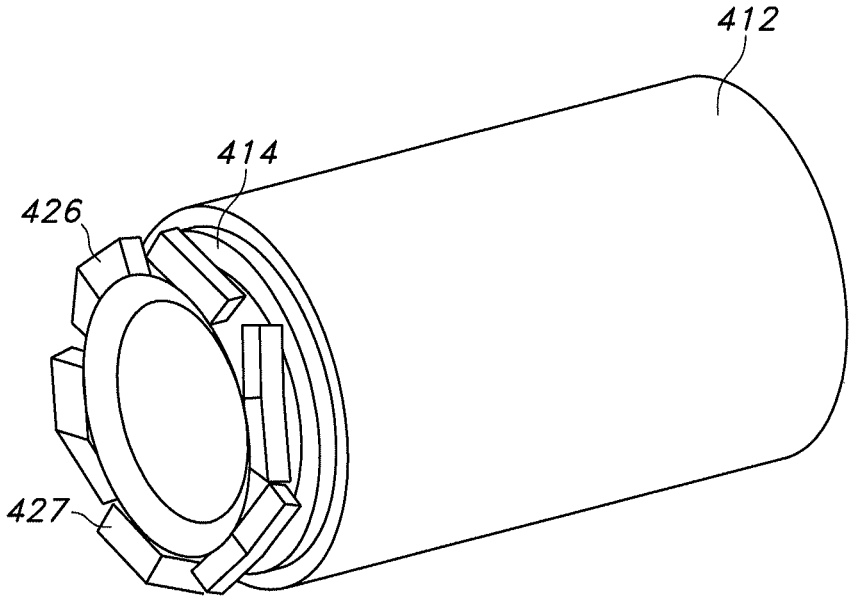
FIG. 10 is a first embodiment of a spring grounding ring used in the corrosion resistant conduit of the present invention.
Figure 11:
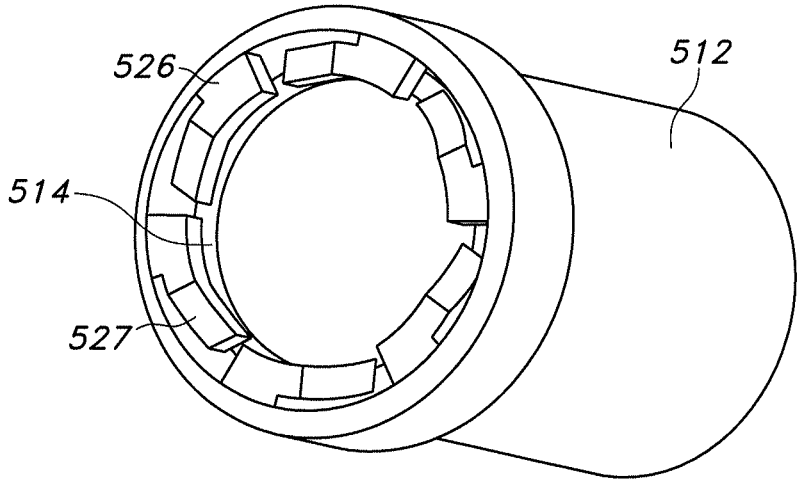
FIG. 11 is a second embodiment of a spring grounding ring used in the corrosion resistant conduit of the present invention.

Additional embodiments of the grounding rings 126 and 136 shown in FIGS. 4 and 5-7 are shown in FIGS. 10 and 11, wherein spring grounding rings 426, 526, respectively, are shown installed onto the metal tube 414, 514 of a multi-layer conduit pipe 412, 512 after the outer polymeric layer near the end of the multi-layer conduit pipe 412, 512 is removed. The grounding rings 426, 526 use different spring designs 427, 527 to provide pressurized contact between the rings 426, 526 and the metal tube 414, 514 of the conduit pipe 412, 512, thus providing a good electrical grounding path.

Example 3

Conduit External Polymeric Layer Removing Tool

Figure 12:
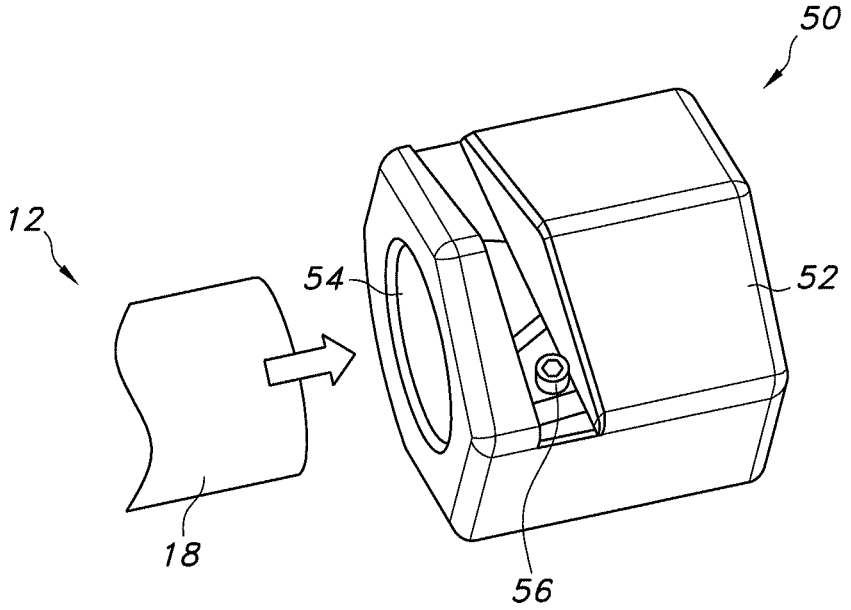
FIG. 12 is a peripheral side view of a conduit polymeric layer removal tool prior to insertion of a conduit with interior and exterior polymeric layers.
Figure 13:
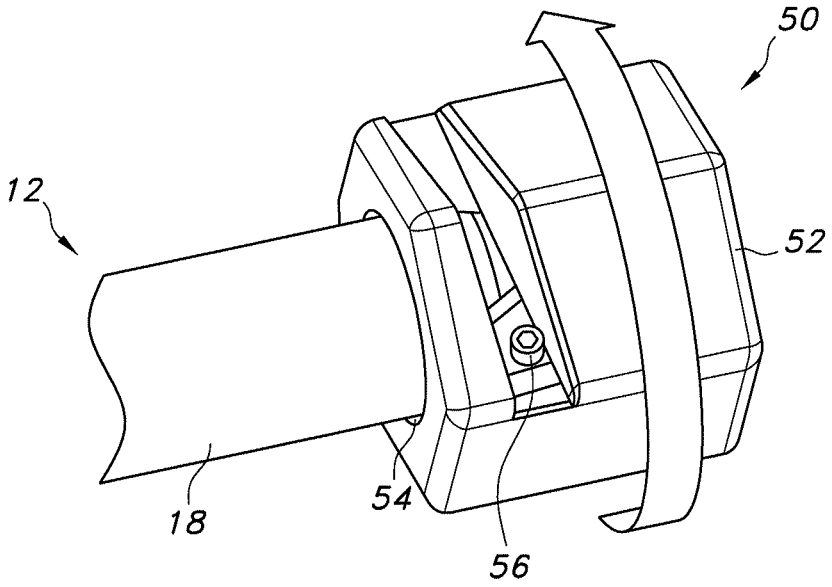
FIG. 13 is a peripheral side view of the conduit polymeric layer removal tool shown in FIG. 12 after the conduit with interior and exterior polymeric layers is inserted.
Figure 14:
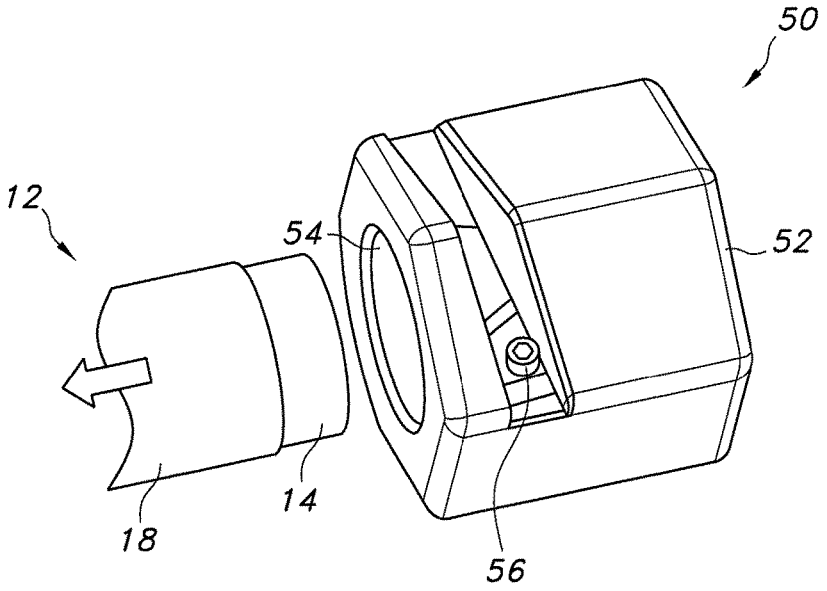
FIG. 14 is a peripheral side view of the conduit polymeric layer removal tool shown in FIG. 12 after the conduit with interior and exterior polymeric layers is removed.
Figure 15:
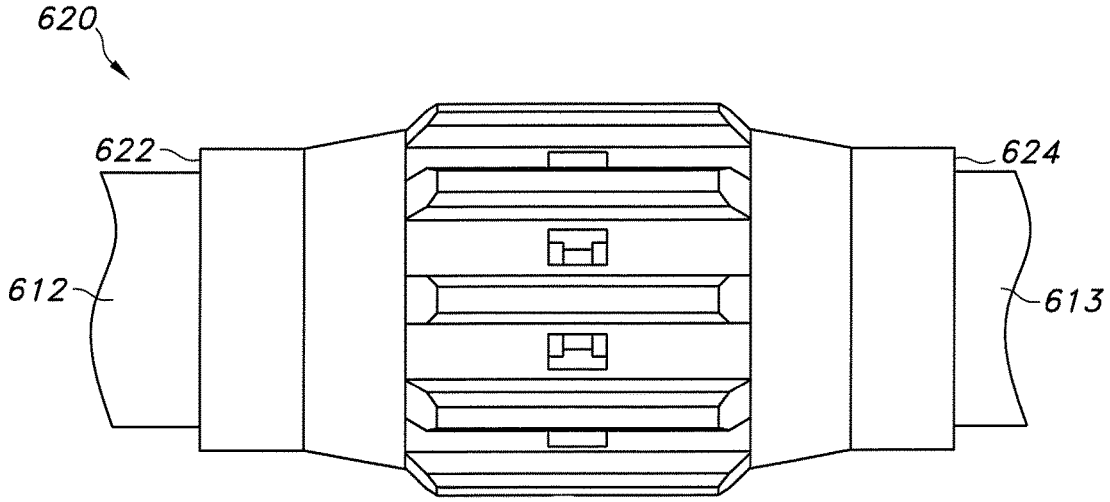
FIG. 15 is a side view of a conduit fitting with a viewing window that connects two conduits.

A conduit polymeric layer removing tool 50 can be used to remove a portion of the external polymeric layer 18 of a conduit 12 before installing a fitting 20 onto the conduit 12. FIGS. 12-14 show an embodiment of the conduit polymeric layer remover 50, which includes a body 52, an opening 54 for receiving the conduit 12 and a blade 56. The conduit polymeric layer remover 50 works in a manner similar to a manual pencil sharpener. The conduit 12 with a polymeric exterior layer 18 is inserted into the opening 54 in the body 52 of the remover 50 and the conduit 12 is secured while the remover 50 is rotated by hand or with a wrench. The blade 56 removes the polymeric outer layer 18 to expose the metallic layer 14 of the conduit 12. The exposed surface may then be provided with a fitting having a metallic surface that contacts the metallic layer 14 of the conduit 12 to establish an electrical connection for grounding the conduit system. Optionally, a grounding ring can be used for electrically connecting the conduit and fitting.

Figure 16:
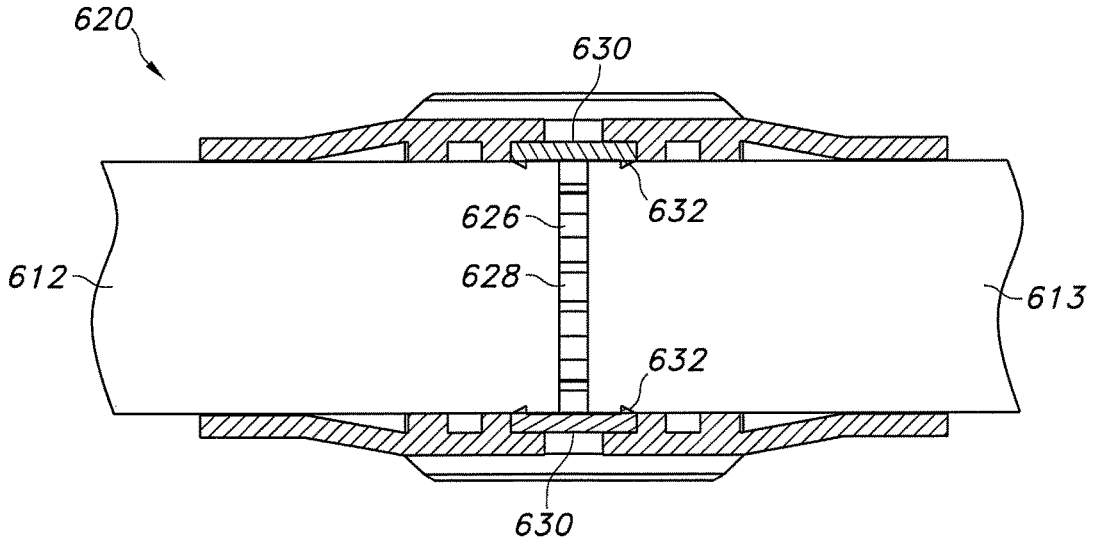
FIG. 16 is a sectional side view of the conduit fitting shown in FIG. 15 with two conduits installed in the fitting.
Figure 17:
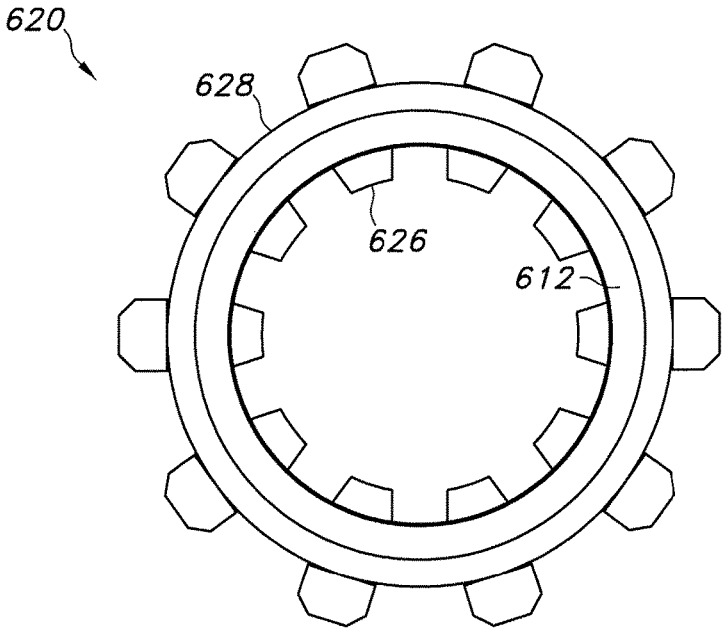
FIG. 17 is an end view of the conduit fitting shown in FIG. 15.
Figure 18:
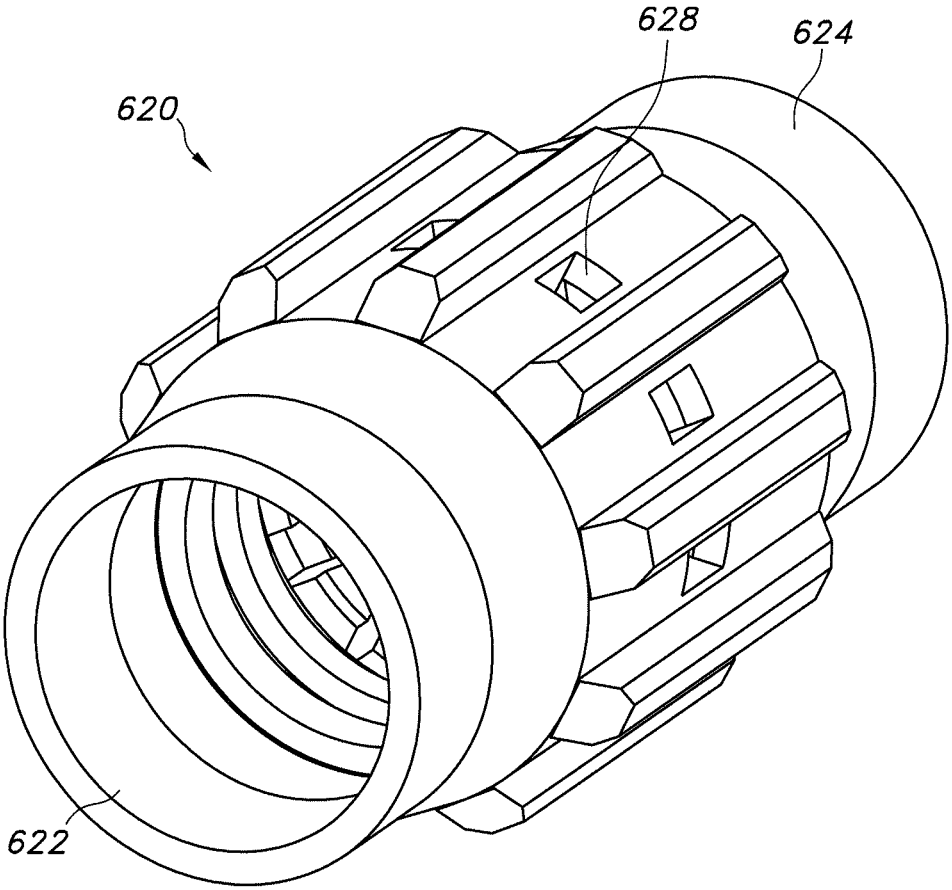
FIG. 18 is a peripheral side view of the conduit fitting shown in FIG. 15.

FIGS. 15-18 show a conduit fitting in the form of a coupler 620 with two connections 622, 624 for connecting two multilayer conduits 612, 613. The coupler 620 has a conduit stop 626 to limit the distance the conduits 612, 613 can be inserted and one or more viewing windows or apertures 628, which are overmolded with clear polymer so that the user may view the inserted ends of the conduits 612, 613 to confirm proper installation of the conduits 612, 613 in the coupler 620, as well as a visual inspection of the wires/cables installed in the conduits 612, 613. FIG. 16 is a sectional side view of the conduit fitting 620 and it shows how the conduit stops 626 position the conduits 612, 613 in the coupling 620 and how the apertures 628 provide a view of the position of the ends of the conduits 612, 613. FIG. 16 also shows a grounding band 630 that electrically connects the metallic layers of the conduits 612, 612. The grounding bands 630 can have teeth 632 on either side that penetrate the outer coatings of the conduit 612, 613 to electrically contact the metallic layer. FIG. 17 is an end view of the coupler 620 with a conduit 612 installed and it shows the plurality of conduit stops 626 in the middle of the coupler 620. FIG. 18 shows the stepped construction of the internal surface of the coupler 620 that can be used for sealing rings, barbed inserts, or other sealing and fixation features.

Figure 19:
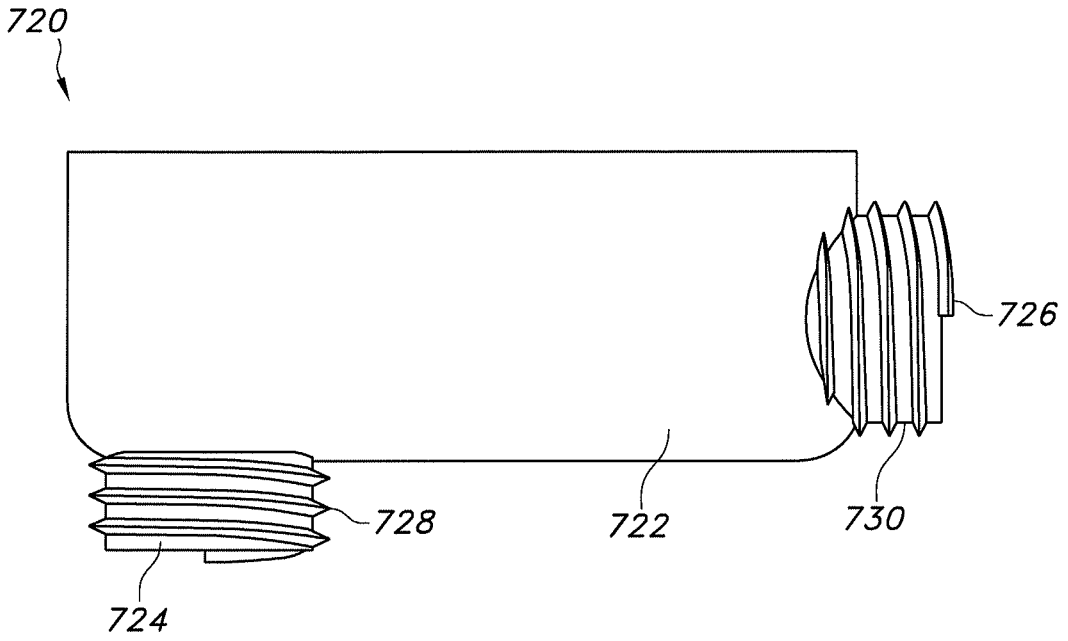
FIG. 19 is a side view of a conduit fitting with metallic threaded inserts overmolded or insert molded in the conduit body.
Figure 20:
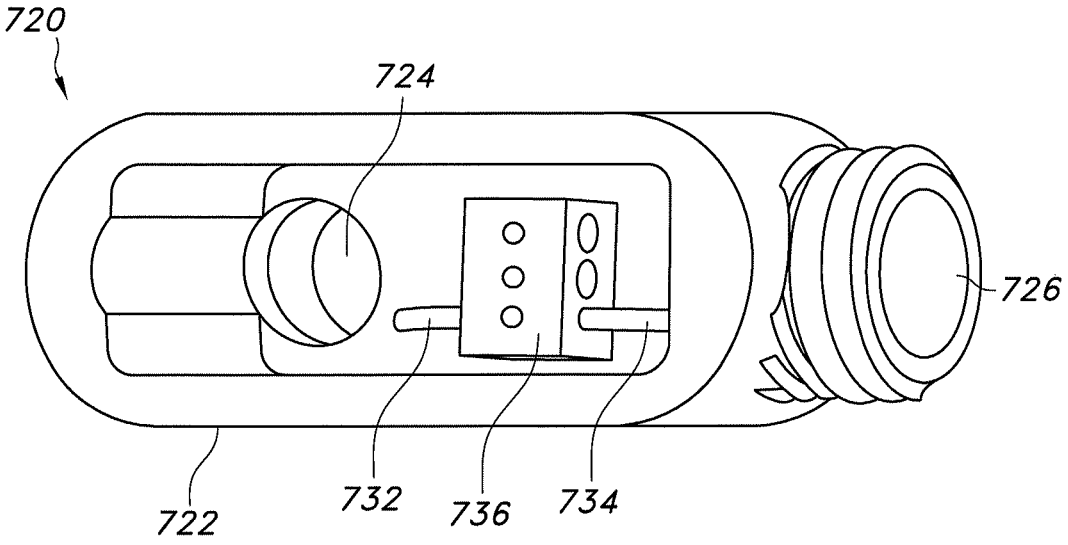
FIG. 20 is a top peripheral view of the conduit body show in FIG. 19 with the cover removed.

FIGS. 19 and 20 show a non-metallic, preferably polymeric, conduit fitting 720 having two conduit connections 724, 726 with metallic threaded inserts 728, 730 overmolded or insert molded in the conduit body 722. Grounding tails 732, 734 from wires or cables in conduits connected to the fitting 720 can be connected to a grounding terminal 736 to connect the equipment grounding conductor to the conduit grounding system. In one embodiment, the metallic inserts 728, 730 are inserted after molding. The grounding tails 732, 734 may be overmolded, or alternatively, the grounding tails 732, 734 may be welded to the grounding rings and then field connected to the grounding terminal 736 in the conduit body 722. The conduit can be secured by gland nuts (not shown) tightened around the overmolded insert.

Figure 21:
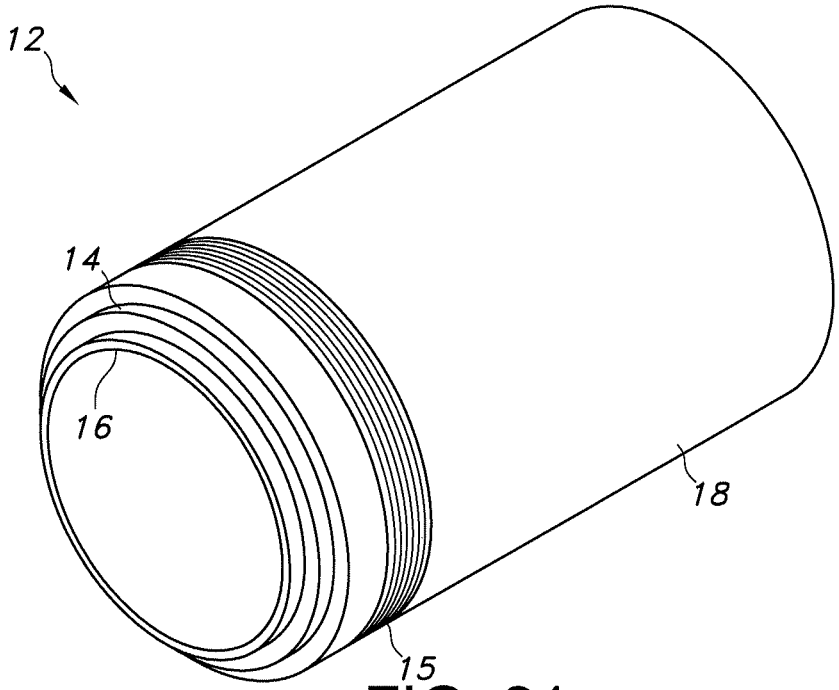
FIG. 21 is a peripheral side view of a conduit pipe with axial ridges that engage sealing or toothed elements on the fittings.
Figure 22:
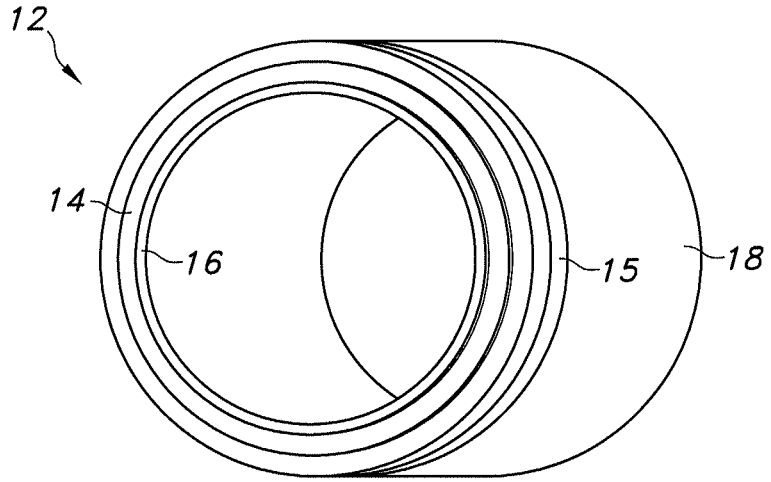
FIG. 22 is a peripheral end view of the conduit pipe in FIG. 21.

FIGS. 21 and 22 show a multilayer conduit pipe 12 having a metallic layer 14 disposed between a polymeric interior layer 16 and a polymeric outer layer 18 with a plurality of ridges 15 in the exterior layer 18 that extend around the circumference of the conduit pipe 12 and engage the sealing or toothed elements on the fittings 20.

Figure 23:
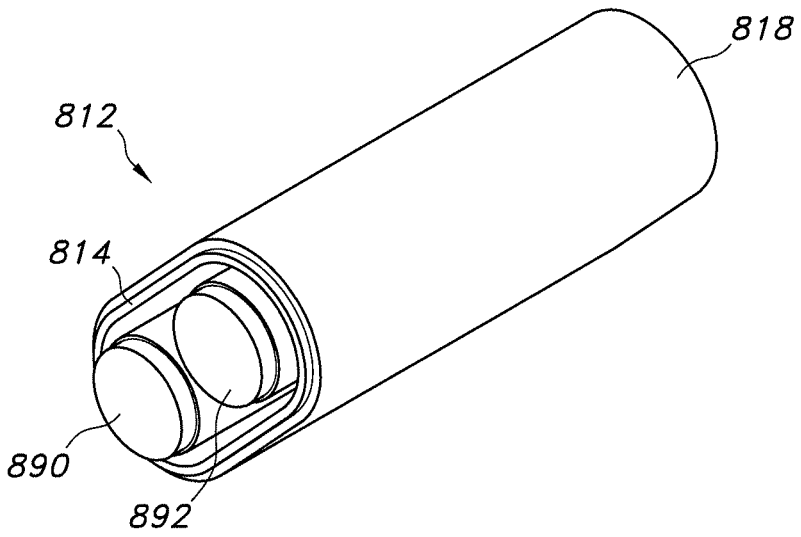
FIG. 23 is a peripheral side view of an oval-shaped conduit that accommodates a single phase or DC circuit of two conductors.
Figure 24:
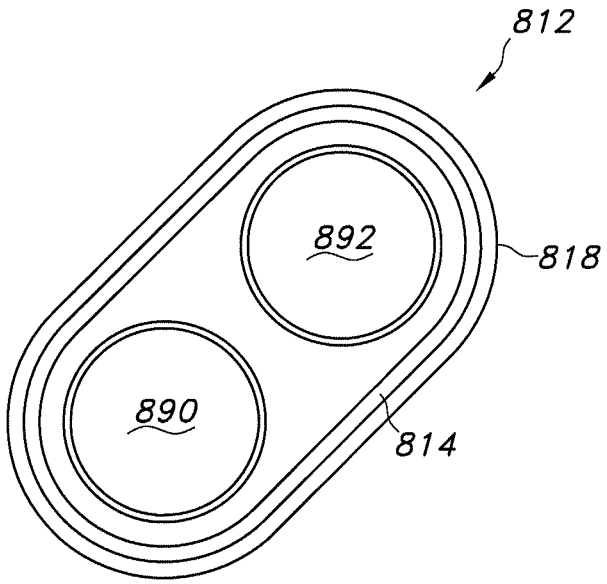
FIG. 24 is an end view of the oval-shaped conduit in FIG. 23.

FIGS. 23 and 24 show an oval-shaped conduit 812 with a two-layer construction formed by a metallic inner layer 814 covered by an exterior polymeric layer 818. The conduit 812 can accommodate a single phase or DC circuit of two conductors 890, 892 and has a smaller cross-sectional area than a circular conduit.

Figure 25:
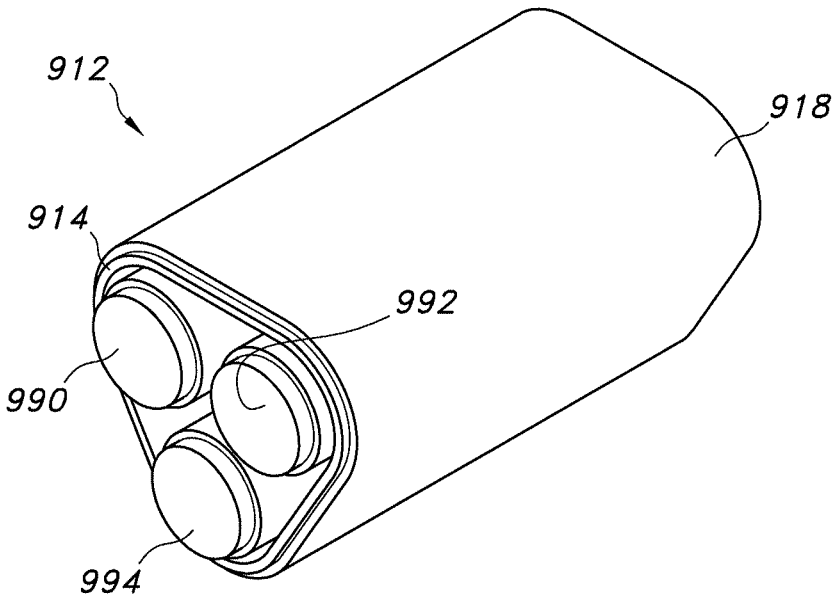
FIG. 25 is a peripheral side view of a triangularly-shaped conduit that accommodates a three phase circuit.
Figure 26:
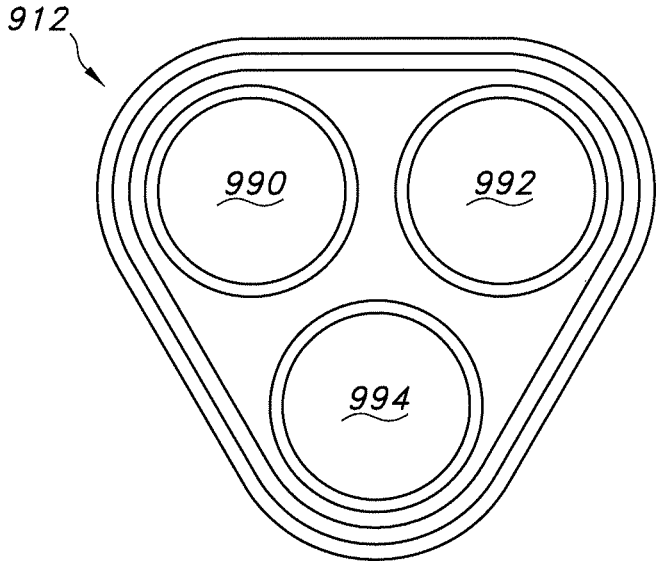
FIG. 26 is an end view of the triangularly-shaped conduit in FIG. 25.

FIGS. 25 and 26 show a triangularly-shaped conduit 912 with a two-layer construction formed by a metallic inner layer 914 covered by an exterior polymeric layer 918. The conduit 912 can accommodate a three phase circuit having three conductors 990, 992, 994.

FIG. 27 shows a non-metallic, preferably polymeric, electrical box 1020 with the cover removed. The electrical box 1020 has a back wall 1022 and four conduit connections 1024, 1026, 1028, 1030. The box 1020 has a bushing 1032 with an aperture 1034 for a grounding continuity screw (not shown) on the exterior for one conduit connection 1024 and a second bushing 1036 with an aperture 1038 for a grounding continuity screw (not shown) on the interior for another conduit connection 1028. The box 1020 also has a threaded boss 1040 extending from the back wall 1022 that is used for a grounding connection to ground the conduits connected to the box 1020. Although the box shown in FIG. 27 is a non-metallic box, the conduit systems of the present invention are not limited to non-metallic boxes and boxes made partly or entirely of metal and metal boxes coated internally and/or externally with a polymeric material are within the scope of the present invention.

Figure 28:
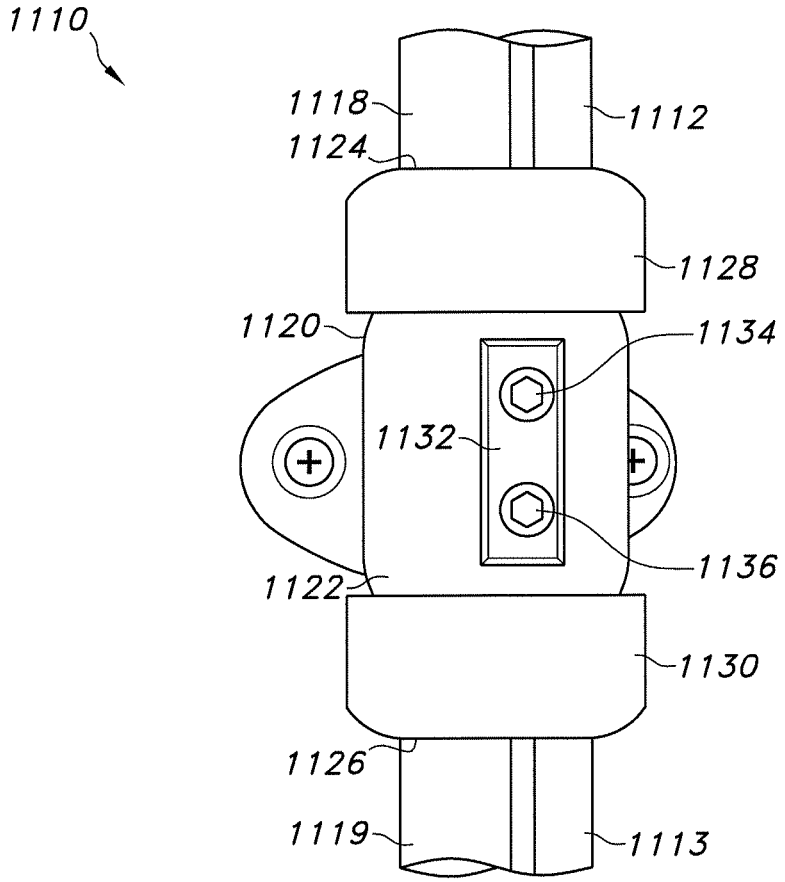
FIG. 28 is side view of a conduit coupler with compression connections and integral grounding bar connected on both ends to polymer coated conduits.

FIG. 28 shows a non-metallic (preferably a polymeric material) conduit fitting 1120 that is a compression type connector for mechanical fixation of two conduits 1112, 1113. The fitting 1120 has a body 1122 with first and second ends 1124, 1126 that receive the ends of the two conduits 1112, 1113. An integral grounding bar 1132 with apertures for two grounding screws 1134, 1136 extends intermediate the first and second ends 1124, 1126. Preferably, the grounding bar 1132 is molded into the body 1122. Before the conduits 1112. 1113 are installed in the fitting 1120, compression caps 1128, 1130 are fitted over the ends of the conduits 1112, 1113 and then compression fit or snap-fit onto the ends 1124, 1126 of the body 1122. The polymeric coatings 1118, 1119 on the ends of the conduits 1112, 1113 do not have to be removed before installation. After the conduits 1112, 1113 are installed, the grounding screws 1134, 1136 are tightened so that they pierce the outer polymeric coatings 1118, 1119 of the conduits 1112, 1113 and electrically connect the conduits 1112, 1113 via the integral grounding bar 1132 to provide electrical continuity in the conduit system 1110. This type of fitting is reversible, similar to compression connectors for EMT conduit. The fitting shown in FIG. 28 has molded feet for mounting to a flat surface.

Figure 29:
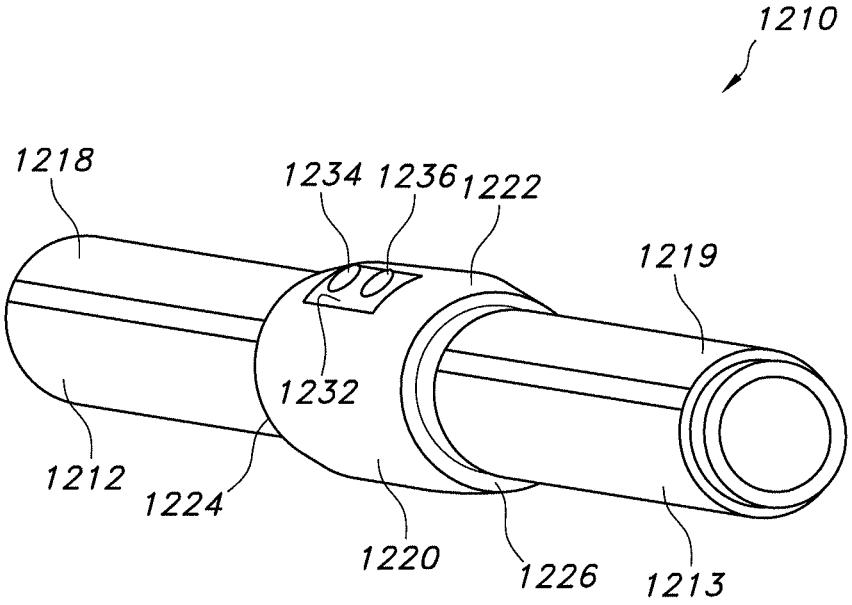
FIG. 29 is a peripheral view of a coupler push-fit connections and integral grounding bar connected on both ends to polymer coated conduits.

FIG. 29 shows a non-metallic (preferably a polymeric material) conduit fitting 1210 that is a push fit type connector for mechanical fixation of two conduits 1212, 1213. The fitting 1220 has a body 1222 with first and second ends 1224, 1226 and a plurality of semi-flexible teeth (not shown-see FIG. 2) on either end that extend from the interior wall of the fitting 1220 at an angle in the direction of the mid-point of the fitting (i.e., the same direction a conduit being installed in the fitting 1220 moves). The teeth are pushed inwardly when the conduits 1212, 1213 are inserted into the fitting 1220 but engage the outer polymeric layers 1218, 1219 of the conduits 1212, 1213 to prevent removal of the conduits 1212, 1213 once they are installed. An integral grounding bar 1232 with apertures for two grounding screws 1234, 1236 extends intermediate the first and second ends 1224, 1226. Preferably, the grounding bar 1232 is molded into the body 1222. The conduits 1212, 1213 are installed in the fitting 1220 by pushing the ends of the conduits 1212, 1213 onto the ends 1224, 1226 of the body 1222. The polymeric coatings 1218, 1219 on the ends of the conduits 1212, 1213 do not have to be removed before installation. After the conduits 1212, 1213 are installed, the grounding screws 1234, 1236 are tightened so that they pierce the outer polymeric coatings 1218, 1219 of the conduits 1212, 1213 and electrically connect the conduits 1212, 1213 via the integral grounding bar 1232 to provide electrical continuity in the conduit system 1210. This type of fitting is non-reversible and cannot be removed without damaging the fitting 1220 and/or the conduits 1112, 1113.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

We claim:

1. A corrosion resistant conduit system comprising:

a multilayer conduit having a first end, a second end and a hollow region extending therebetween and comprising a metallic layer disposed between an exterior polymeric layer and the hollow region;

a conduit fitting comprising an electrically conductive component, a polymeric outer layer, an interior and first and second openings for receiving multilayer conduits and providing access to the interior;

means for conductively coupling the metallic layer of the multilayer conduit to the electrically conductive component of the fitting, wherein a continuous electrical path is formed throughout the corrosion resistant conduit system, wherein the electrically conductive component of the conduit fitting is a metallic layer disposed between the polymeric outer layer and the interior, and wherein the conduit fitting further comprises an inner layer of polymeric material disposed between the metallic layer and the interior.

2. The corrosion resistant conduit system according to claim 1, wherein the multilayer conduit further comprises an interior polymeric layer disposed between the metallic layer and the hollow region.

3. The corrosion resistant conduit system according to claim 1, wherein the multilayer conduit further comprises an interior polymeric layer disposed between the metallic layer and the hollow region.

4. The corrosion resistant conduit system according to claim 3, wherein the polymer materials of the interior and exterior layers of the multilayer conduit and the inner and outer layers of the conduit fitting include multiple layers of polymer materials or cross-linked polymers or comprise polyethylene and/or polypropylene.

5. The corrosion resistant conduit system according to claim 1, wherein the metallic layer of the conduit and the electrically conductive component of the conduit fitting are fabricated from steel or aluminum or copper or titanium or magnesium.

6. The corrosion resistant conduit system according to claim 1, wherein the electrically conductive component of the conduit fitting is a metallic body, a ground bar or an electrically conductive screw or a grounding ring.

7. The corrosion resistant conduit system according to claim 1, wherein the electrically conductive component of the conduit fitting is a grounding ring comprising:

a substantially flat annular base having an exterior perimeter and an interior perimeter that defines an opening;

a continuous perimetrical side wall extending from the exterior perimeter of the annular base; and one or more legs extending from the perimetrical side wall to distal ends, each leg having one or more teeth extending inwardly, wherein the teeth penetrate the exterior polymeric layer of the multilayer conduit pipe and electrically contact the metallic layer.

8. The corrosion resistant conduit system according to claim 1, wherein the conduit fitting has a body made from a polymeric material and the electrically conductive component is a ground bar, a grounding terminal, a threaded metallic stud, or a threaded metallic boss.

9. The corrosion resistant conduit system according to claim 1, wherein the conduit fitting is a push-fit, snap-fit, quarter-turn or releasable connector.

10. The corrosion resistant conduit system according to claim 1, wherein the conduit fitting further comprises a passage extending between the first and second openings, wherein the passage has at least one conduit stop to limit the insertion of a conduit into the fitting.

11. The corrosion resistant conduit system according to claim 1, wherein the electrically conductive component is an annular grounding band for electrically connecting the multilayer conduits.

12. A corrosion resistant conduit system comprising:

a multilayer conduit having a first end, a second end and a hollow region extending therebetween and comprising a metallic layer disposed between an exterior polymeric layer and the hollow region;

a conduit fitting comprising an electrically conductive component, a polymeric outer layer, an interior and first and second openings for receiving multilayer conduits and providing access to the interior;

means for conductively coupling the metallic layer of the multilayer conduit to the electrically conductive component of the fitting, wherein a continuous electrical path is formed throughout the corrosion resistant conduit system, and wherein the conduit fitting further comprises one or more apertures filled with a clear plastic material and located intermediate the first and second openings, wherein the apertures provide a view of the interior.

13. The corrosion resistant conduit system according to claim 1, wherein the conduit fitting further comprises a plurality of teeth located between the first opening and the interior and between the second opening and the interior, wherein the plurality of teeth engage the polymeric exterior layer of the multilayer conduit and secure the multilayer conduit in the fitting.

* * * * *